US010667058B2

(12) United States Patent
Xie et al.

(10) Patent No.: US 10,667,058 B2
(45) Date of Patent: May 26, 2020

(54) DIAPHRAGM AND SPEAKER

(71) Applicant: SHENZHEN GRANDSUN ELECTRONIC CO., LTD., Shenzhen, Guangdong (CN)

(72) Inventors: Gang Xie, Shenzhen (CN); Haiquan Wu, Shenzhen (CN); Weiyong Gong, Shenzhen (CN); Mickael Bernard Andre Lefebvre, Shenzhen (CN); Ruiwen Shi, Shenzhen (CN)

(73) Assignee: SHENZHEN GRANDSUN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/247,356

(22) Filed: Jan. 14, 2019

(65) Prior Publication Data

US 2019/0335276 A1 Oct. 31, 2019

(30) Foreign Application Priority Data

Apr. 28, 2018 (CN) ..... 2018 1 0402942
Apr. 28, 2018 (CN) ..... 2018 2 0638191 U

(51) Int. Cl.

| | |
|---|---|
| ***H04R 7/12*** | (2006.01) |
| ***H04R 7/18*** | (2006.01) |
| ***H04R 31/00*** | (2006.01) |
| ***H04R 9/06*** | (2006.01) |

(52) U.S. Cl.

CPC ..... *H04R 7/127* (2013.01); *H04R 7/18* (2013.01); *H04R 9/06* (2013.01); *H04R 31/003* (2013.01); *H04R 2307/021* (2013.01); *H04R 2307/027* (2013.01)

(58) Field of Classification Search

CPC . H04R 7/127; H04R 7/18; H04R 9/06; H04R 31/003; H04R 2307/021; H04R 2307/027

See application file for complete search history.

(56) References Cited

U.S. PATENT DOCUMENTS

2010/0092023 A1* 4/2010 Bryant ..... H04R 7/122 381/397
2017/0180865 A1* 6/2017 Fujitani ..... H04R 31/003

* cited by examiner

*Primary Examiner* — Sunita Joshi
(74) *Attorney, Agent, or Firm* — Conley Rose, P.C.; Grant Rodolph

(57) ABSTRACT

A diaphragm, including: a metal dome, a non-metallic diaphragm portion, and a flexible rim. The non-metallic diaphragm portion is bonded to a metal dome outer periphery, and a non-metallic diaphragm portion outer periphery extends corresponding to a convex direction of the metal dome and expands radially away from the metal dome. The flexible rim is bonded to the non-metallic diaphragm portion outer periphery. The diaphragm of the present application adopts the combination of the metal dome, the non-metallic diaphragm portion, and the flexible rim, the overall rigidity of the diaphragm is enhanced, and the internal damping property of the diaphragm and the compliance of the vibration of the diaphragm can be adjusted, which can effectively reduce segmentation vibration of the diaphragm during high-frequency vibration and reduce the segmentation distortion of the diaphragm at high frequencies, thereby extending the bandwidth of the diaphragm.

20 Claims, 5 Drawing Sheets

DIAPHRAGM AND SPEAKER

CROSS-REFERENCE TO RELATED APPLICATIONS

This application claims priority to Chinese Patent Application No. 201810402942.0 filed on Apr. 28, 2018, and to Chinese Patent Application No. 201820638191.8 filed Apr. 28, 2018, the contents of which are incorporated herein by reference.

BACKGROUND

Technical Field

The present application relates to the technical field of electroacoustic products, and more particularly to a diaphragm and a speaker.

Description of Related Art

In recent years, speakers in the market have been more and more highly required on their functional properties. A diaphragm serves one of the main components for vibration and sound generation in the speaker, the quality of the diaphragm greatly affects the effective frequency range, the distortion, and the sound quality of the speaker and is therefore a key design that controls the sound of the speaker. The performance of the diaphragm depends on the geometry and material thereof. However, the conventional diaphragm is generally made of paper, plastic, or a single material such as aluminum and an aluminum alloy. The diaphragm made of such materials always has insufficient rigidity and damping property or cannot balance the rigidity and the damping property, thus the speaker tends to have segmentation distortion problem at high frequency vibration, thereby affecting the sound of the speaker.

SUMMARY

It is an object of the present application to provide a diaphragm and a speaker, which aims at solving the technical problem that the existing speaker tends towards distortion due to insufficient rigidity and damping property of the speaker.

In order to achieve the above purpose, the present application adopts the following technical solution: a diaphragm comprises a metal dome, a non-metallic diaphragm portion, and a flexible rim. The non-metallic diaphragm portion is bonded to an outer periphery of the metal dome, and an outer periphery of the non-metallic diaphragm portion extends corresponding to a convex direction of the metal dome and expands radially away from the metal dome. The flexible rim is bonded to the outer periphery of the non-metallic diaphragm portion.

In one embodiment, the non-metallic diaphragm portion comprises an annular plain section and a horn-like conical section. The annular plain section is formed by extending the outer periphery of the metal dome in a direction perpendicular to the convex direction away from the metal dome. The horn-like conical section is formed by folding an outer periphery of the annular plain section toward the convex direction of the metal dome and expanding the outer periphery of the annular plain section away from the metal dome.

In one embodiment, a maximum height of the outer periphery of the horn-like conical section of the non-metallic diaphragm portion is greater than a maximum height of the metal dome.

In one embodiment, both an upper surface and a lower surface of the annular plain section are regularly flat and in parallel with a horizontal plane.

In one embodiment, a cross section of the metal dome and a cross section of the non-metallic diaphragm portion together form a W shape.

In one embodiment, an intermediate portion of the flexible rim is arched toward the convex direction of the metal dome to form a curved structure.

In one embodiment, the metal dome is made of at least one material selected from the group consisting of magnesium, aluminum, beryllium, and titanium.

In one embodiment, the non-metallic diaphragm portion is made of paper, a mixture of paper and mica, a mixture of paper and a blended fabric material, or a biological diaphragm material.

In one embodiment, the flexible rim is made of a polyurethane (PU) material, a silica gel, a plastic, a resin, a silk, or a cloth.

In one embodiment, a thickness of the metal dome is preferably between 6 micrometers (μm) and 120 μm.

In one embodiment, the metal dome and the non-metallic diaphragm portion are bonded together by a positive bonding process or a reverse bonding process.

The diaphragm provided by the application comprises the metal dome, the non-metallic diaphragm portion, and the flexible rim, which are made of different materials. Among them, the metal dome is made of a metal material with relatively strong rigidity, which enhances the overall rigidity of the diaphragm and reduces segmentation distortion of the diaphragm. The non-metallic diaphragm portion is made of a non-metallic material with a relatively light weight, which reduces the overall weight of the diaphragm, and moreover, the non-metallic material has better damping property, which is capable of improving and adjusting internal damping property of the diaphragm, and effectively extending the high frequency of the diaphragm. The flexible rim is made of a flexible material, the flexibility of which can effectively improve the compliance of the diaphragm, ensure the normal vibration of the diaphragm, and increase the internal damping of the diaphragm. Therefore, based on the combination of the metal dome, the non-metallic diaphragm portion, and the flexible rim, the overall rigidity of the diaphragm is enhanced, and in the meanwhile, the internal damping property of the diaphragm and the compliance of the vibration of the diaphragm can be adjusted, which can effectively reduce segmentation vibration of the diaphragm during high-frequency vibration and reduce the segmentation distortion of the diaphragm at high frequencies, thereby extending the bandwidth of the diaphragm and improving the overall performance of the diaphragm.

Another technical solution provided by the present application is a speaker comprising the above-mentioned diaphragm.

In the electronic product of the present application, because the above diaphragm is adopted, a vibration system of the speaker has enhanced rigidity and internal damping property. The segmentation vibration of the speaker at high frequencies is reduced, the bandwidth of the speaker is effectively extended, and the distortion of the speaker is reduced, thus realizing a full-range frequency type speaker with moderate damping, wide dynamic range, and abundant sound, and improving the users' listening experience.

BRIEF DESCRIPTION OF THE DRAWINGS

In order to more clearly illustrate the technical solution in embodiments of the present application, the following drawings, which are to be used in the description of the embodiments or the prior art, will be briefly described. It will be apparent that the drawings described in the following description are merely embodiments of the present application. Other drawings may be obtained by those skilled in the art without paying creative labor.

Figure 1:
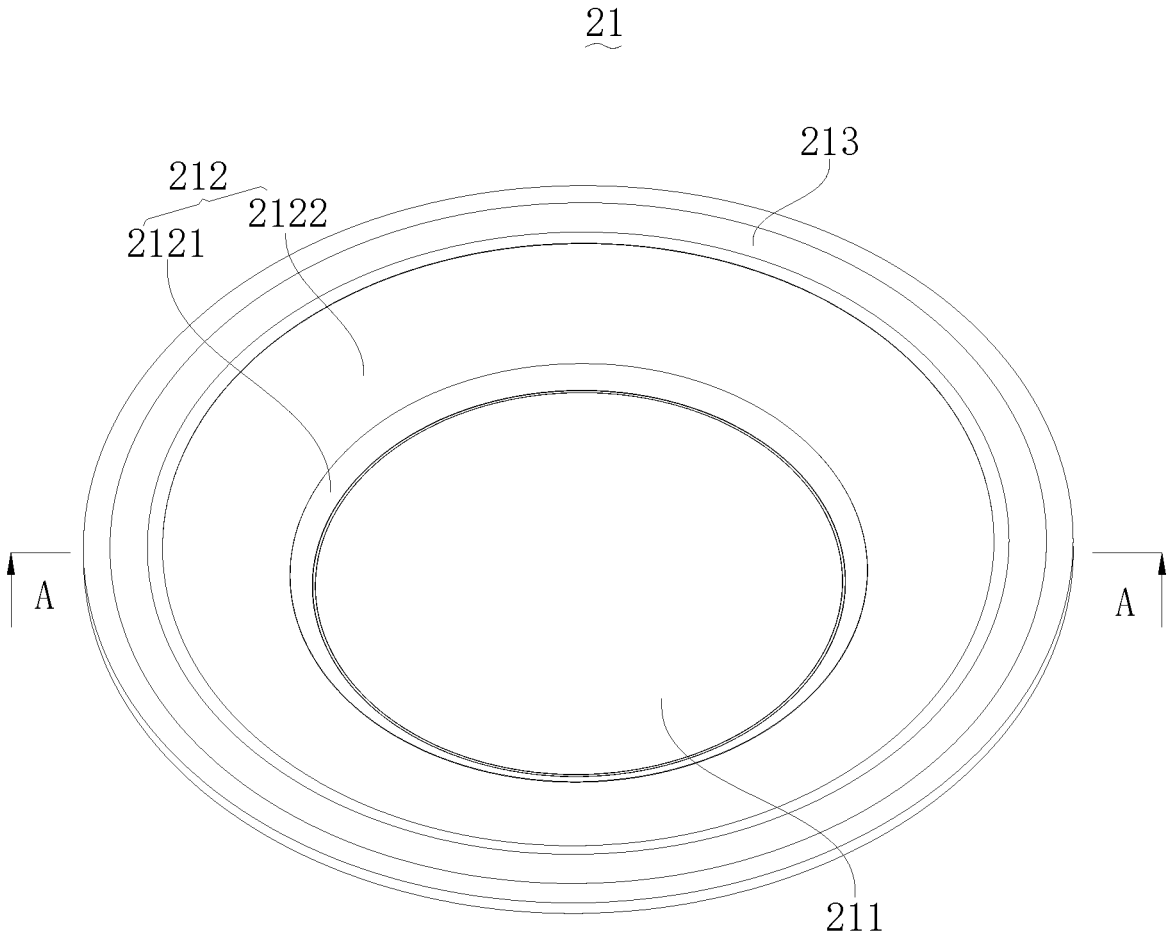
FIG. 1 is a structural schematic view of a diaphragm according to a first embodiment of the present application.

In the drawings, the following reference numerals are used: 10: Magnetic circuit system, 11: Magnetic member, 12: Magnet, 20: Vibration system, 21: Diaphragm, 22: Voice coil, 30: Speaker holder, 31: U cup, 32: Speaker basket, 40: Damping enhancing system, 41: First damper, 42: Second damper, 50: Circuit board, 111: First magnet gap, 121: Second magnet gap, 211: Metal dome, 212: Non-metallic diaphragm portion, 213: Flexible rim, 311: Through hole, 2121: Annular plain section, and 2122: Horn-like conical section.

DETAILED DESCRIPTION OF THE EMBODIMENTS

The embodiments of the present application are described in detail hereinbelow, and the examples of the embodiments are illustrated in the drawings, where the same or similar reference numerals are used to refer to the same or similar elements or elements of the same or similar functions. The embodiments described hereinbelow with reference to the accompanying FIGS. 1-5 are intended to be illustrative of the present application and are not to be construed as limiting.

It should be understood that terms "length", "width", "upper", "lower", "front", "rear", "left", "right", "vertical", "horizontal", "top", "bottom", "inside", "outside" and the like indicating orientation or positional relationship are based on the orientation or the positional relationship shown in the drawings, and are merely for facilitating and simplifying the description of the present application, rather than indicating or implying that a device or component must have a particular orientation, or be configured or operated in a particular orientation, and thus should not be construed as limiting the application.

Moreover, the terms "first" and "second" are adopted for descriptive purposes only and are not to be construed as indicating or implying a relative importance or implicitly indicating the number of technical features indicated. Thus, features defining "first" and "second" may include one or more of the features either explicitly or implicitly. In the description of the present application, the meaning of "a plurality of" or "multiple" is two or more unless otherwise specifically defined.

In the present application, unless otherwise explicitly defined or specified, the terms "installation", "connected", "coupled", "fixed" and the like shall be understood broadly as, for example, either a fixed connection or a detachable connection, or being integrated as a whole, mechanical connection or electrical connection, direct connection or indirect connection via an intermediate medium, or internal communication of two elements or the interaction between two elements. Specific meanings of the above terms in the present application can be understood by those skilled in the art according to specific circumstances.

First Embodiment

Figure 2:
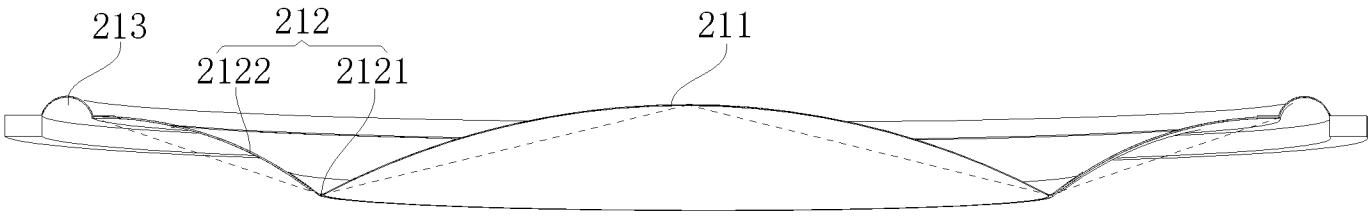
FIG. 2 is a cross-sectional view taken from line A-A of FIG. 1.

As shown in FIGS. 1-2, the present application provides a diaphragm 21. The diaphragm 21 comprises: a metal dome 211, a non-metallic diaphragm portion 212, and a flexible rim 213. The non-metallic diaphragm portion 212 is bonded to an outer periphery of the metal dome 211, and an outer periphery of the non-metallic diaphragm portion 212 extends corresponding to a convex direction of the metal dome 211 and expands radially away from the metal dome 211, that is, the outer periphery of the non-metallic diaphragm portion 212 extends away from the metal dome 211. The flexible rim 213 is bonded to the outer periphery of the non-metallic diaphragm portion 212, that is, the flexible rim 213 is in connection with the outer periphery of the non-metallic diaphragm portion 212, and an outer periphery of the flexible rim 213 extends away from the metal dome 211.

The diaphragm 21 provided by this embodiment of the application comprises the metal dome 211, the non-metallic diaphragm portion 212, and the flexible rim 213, which are made of different materials. Among them, the metal dome 211 is made of a metal material with relatively strong rigidity, which enhances the overall rigidity of the diaphragm 21 and reduces segmentation distortion of the diaphragm 21. The non-metallic diaphragm portion 212 is made of a non-metallic material with a relatively light weight, which reduces the overall weight of the diaphragm 21, and moreover, the non-metallic material has better damping property, which is capable of improving and adjusting internal damping property of the diaphragm 21, and effectively extending the high frequency of the diaphragm 21. The flexible rim 213 is made of a flexible material, the flexibility of which can effectively improve the compliance of the diaphragm 21, ensure the normal vibration of the diaphragm 21, and increase the internal damping of the diaphragm 21. Therefore, based on the combination of the metal dome 211, the non-metallic diaphragm portion 212, and the flexible rim 21, the overall rigidity of the diaphragm 21 is enhanced, and in the meanwhile, the internal damping property of the diaphragm 21 and the compliance of the vibration of the diaphragm 21 can be adjusted, which can effectively reduce segmentation vibration of the diaphragm 21 during high-frequency vibration and reduce the segmentation distortion of the diaphragm 21 at high frequencies, thereby extending the bandwidth of the diaphragm 21, improving the overall performance of the diaphragm 21, and enabling the diaphragm 21 to realize frequency response within a full frequency band (20 hertz (Hz)-20 kilohertz (kHz)).

In the present embodiment, as shown in FIG. 2, the non-metallic diaphragm portion 212 comprises an annular plain section 2121 and a horn-like conical section 2121. The annular plain section 2121 is formed by extending the outer periphery of the metal dome 211 in a direction perpendicular to the convex direction away from the metal dome. The horn-like conical section 2122 is formed by folding an outer periphery of the annular plain section 2121 toward a convex direction of the metal dome 211 and expanding the outer periphery of the annular plain section 2121 away from the metal dome 211. That is, the diaphragm 21 of the present embodiment comprises the metal dome 211 in a semispherical shape with a convex center, the outer periphery of the semispherical metal dome 211 extends in in the direction perpendicular to the convex direction away from the metal dome to form the annular plain section 2121 in the annular shape, the outer periphery of the annular plain section 2121 continues to be folded towards the convex direction of the metal dome 211 and extends away from the metal dome 211 to form the horn-like conical section 2122 in a horn shape.

Particularly, because the metal dome 211 adopts a semi-spherical structure with the center thereof convex outward, as the diaphragm 21 vibrates, the metal dome 211 vibrates and produces a first force which is away from the metal dome 211 and applied to the annular plain section 2121 arranged in the middle. In the meanwhile, because the horn-like conical section 2122 is arranged to be convex toward the metal dome 211, when the diaphragm 21 vibrates, the horn-like conical section 2122 exerts a second force facing towards the metal dome 211 on the annular plain section 2121. The first force and the second force are simultaneously applied to the annular plain section 2121, or alternatively, the first force is transmitted to the horn-like conical section 2122 via the annular plain section 2121, and the second force is transmitted to the metal dome 211 via the annular plain section 2121. Moreover, the first force and the second force are opposite in direction. When the first force and the second force are applied to the annular plain section 2121 in the planar structure, both the two forces may be partially or completely offset, thereby fully or partially offsetting the force which is produced in the vibration of the diaphragm 21 and may cause the deformation of the diaphragm 21, and improving the rigidity of the diaphragm 21. In addition, on the premise of keeping a certain rigidity, the thickness of the diaphragm 21 is reduced, the internal damping property of the diaphragm 21 is increased, thereby weakening the segmentation distortion of the diaphragm 21 at high frequencies and ensuring the normal vibration of the diaphragm 21.

Figure 5:
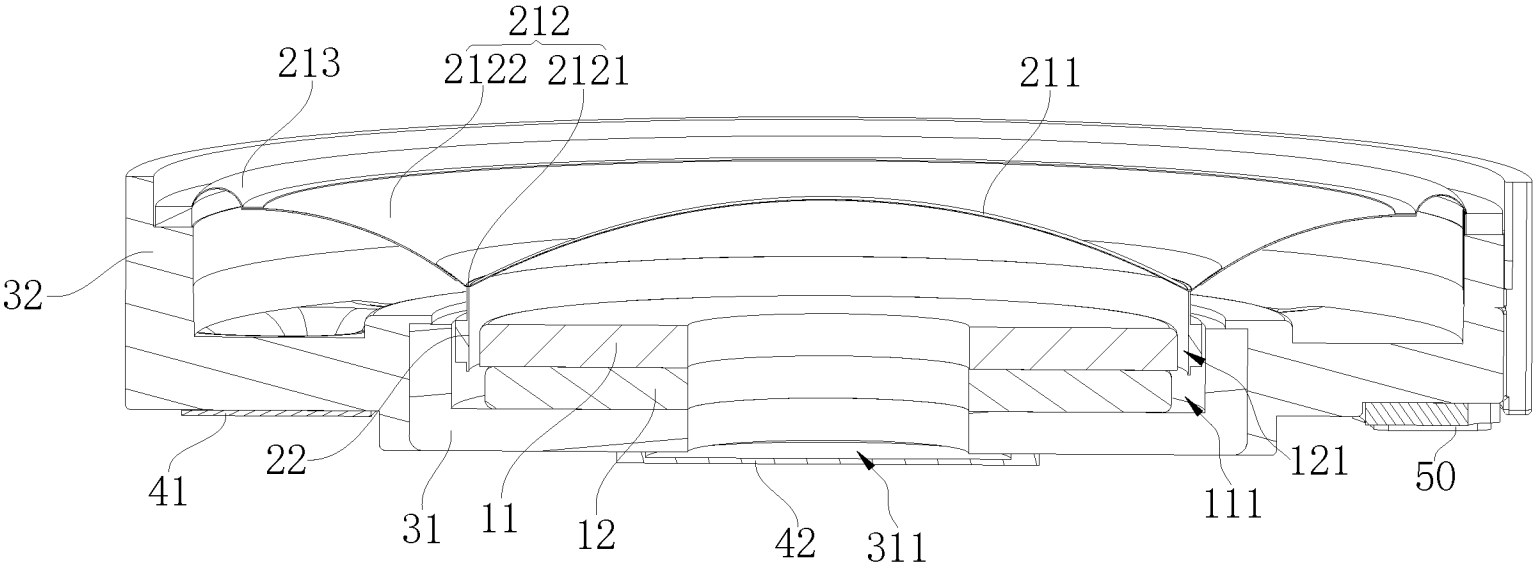
FIG. 5 is a cross-sectional view taken from line B-B of FIG. 3.

In the present embodiment, as shown in FIG. 5, a maximum height of the outer periphery of the horn-like conical section 2122 of the non-metallic diaphragm portion 212 is greater than a maximum height of the metal dome 211. Thus, when the diaphragm 21 is fixed at a speaker holder, the metal dome 211 can vibrate within a vibration space formed by enclosing the horn-like conical section 2122 and the speaker holder, thus providing the metal dome 211 with a larger vibration space and effectively expanding the vibration frequency range of the diaphragm 21.

In the present embodiment, as shown in FIGS. 2 and 5, both an upper surface and a lower surface of the annular plain section 2121 are regularly flat and in parallel with a horizontal plane. When the diaphragm 21 is applied in the speaker and to be fixedly connected with the voice coil 22, it only requires to bond the voice coil 22 to the lower surface of the annular plain section 2121; that is, the annular plain section 2121 functions in positioning the voice coil 22. In this way, the fixed connection between the voice coil 22 and the diaphragm 21 is more convenient, and the operation thereof is much simpler, besides, the flat surface structure of the annular plain section can improve the contact degree with the voice coil 22, and will not affect the connection stability with the voice coil 22 due to a rough surface. Moreover, when the diaphragm 21 is exerted with a force to vibrate, the annular plain section 2121 also vibrates due to the exertion of the force, as the annular plain section is designed to have flat planar structures on both sides thereof, only forces in the vertical direction are produced during the vibration, and forces in the horizontal direction will not be produced. Regarding the annular plain section 2121, such kind of horizontal forces is not beneficial to the vibration for voice generation, which not only affects the normal vibration of the diaphragm 21 but also may even cause deformation of the diaphragm 21.

In the present embodiment, as shown in FIG. 2, a cross section of the metal dome 211 and a cross section of the non-metallic diaphragm portion 212 together form a W shape, that is, a cross section of the diaphragm 21 as a whole presents a W shape. As indicated by broken lines in FIG. 2, the cross sections of the metal dome 211 and the non-metallic diaphragm portion 212 together form a W-shaped cross section (the diaphragm 21 has a W-shaped cross section), which means that a highest point of the horn-like conical section 2122 on a left side of the metal dome 211, a middle point of the annular plain section 2121 on the left side of the metal dome 211, a dome apex of the metal dome 211, a middle point of the annular plain section 2121 on a right side of the metal dome 211, and a highest point of the horn-like conical section 2122 on the right side of the metal dome 211, which are located in the same cross section, can be sequentially connected to form the W-shaped cross section of the diaphragm 21 of the present embodiment.

In the present embodiment, as shown in FIG. 2, an intermediate portion of the flexible rim 213 is arched toward the convex direction of the metal dome 211 to form a curved structure. The intermediate portion of the flexible rim 213 is arched upwards, which increases the effective vibration area of the flexible rim 213, more effectively ensures the normal vibration and sound generation of the diaphragm 21, and also increases the overall damping property of the diaphragm 21, thereby further increasing the rigidity of the diaphragm 21, improving the harmonic distortion of the diaphragm 21 of the present embodiment at high frequencies, and improving the functional properties of the diaphragm 21.

In the present embodiment, the metal dome 211 is preferably made of at least one metal selected from the group consisting of magnesium, aluminum, beryllium, and titanium, that is, the metal dome 211 is preferably made of magnesium, aluminum, beryllium, titanium, a magnesium alloy, an aluminum alloy, a beryllium alloy, or a titanium alloy. The above metal materials feature strong rigidity and light weight, and the diaphragm 21 made of these metal materials functions in improving the rigidity of the diaphragm 21, reducing the segmentation distortion of the diaphragm 21, and extending the bandwidth of the diaphragm 21.

In the present embodiment, the non-metallic diaphragm portion 212 is preferably made of paper, a mixture of paper and mica, a mixture of paper and a blended fabric material, or a biological diaphragm material. Because the non-metallic material has relatively good damping property, when combined with the metal dome 211, the non-metallic diaphragm portion 212 is capable of improving the internal damping of the metal dome 211, thus functioning in improving the overall rigidity of the diaphragm 21, adjusting the internal damping, and decreasing the distortion of the diaphragm 21.

In the present embodiment, the flexible rim 213 is preferably made of a PU material, a silica gel, a plastic, a resin, a silk, or a cloth. When the flexible rim 213 is combined with the metal dome 211 and the non-metallic diaphragm portion 212 to form the diaphragm 21, due that the flexible material has weaker rigidity, softer texture, and better compliant than the metal materials and other non-metal materials, it is more apt to generate vibration when being exerted with a force, thus more easily causing the diaphragm 21 to vibrate and generate the sound. In addition, because the flexible material has stronger damping property than metal materials and other non-metallic materials, it can also effectively increase the overall damping property of the diaphragm 21, thus reducing the harmonic distortion of the diaphragm 21 of the present embodiment at high frequencies, extending the bandwidth of the diaphragm 21, and improving the overall performance of the diaphragm 21. Particularly, the above plastic material may be one selected from the group consisting of PET, PEN, PEEK, PEI, PAR, and PEI.

In the present embodiment, a thickness of the metal dome 211 is preferably between 6 μm and 120 μm, and the metal dome 211 of different thicknesses has different rigidities. As the thickness of the metal dome 211 increases, the rigidity increases correspondingly. Therefore, in designing the diaphragm 21, the thickness of the metal dome 211 can be selected according to the rigidity required by the diaphragm 21, and the thickness thereof is not particularly limited herein. It may be 6 μm, 10 μm, 30 μm, 50 μm, 40 μm, 60 μm, 80 μm, 100 μm, and 120 μm, etc.

In the present embodiment, the metal dome 211 and the non-metallic diaphragm portion 212 in the above are preferably bonded by a positive bonding process or a reverse bonding process. That is, when the non-metallic diaphragm portion 212 is in bonding connection with the outer periphery of the metal dome 211, it may be that the lower surface of the non-metallic diaphragm portion 212 is bonded to the upper surface of the metal dome 211, it may also be that the upper surface of the non-metallic diaphragm portion 212 is bonded to the lower surface of the metal dome 211.

Second Embodiment

Figure 3:
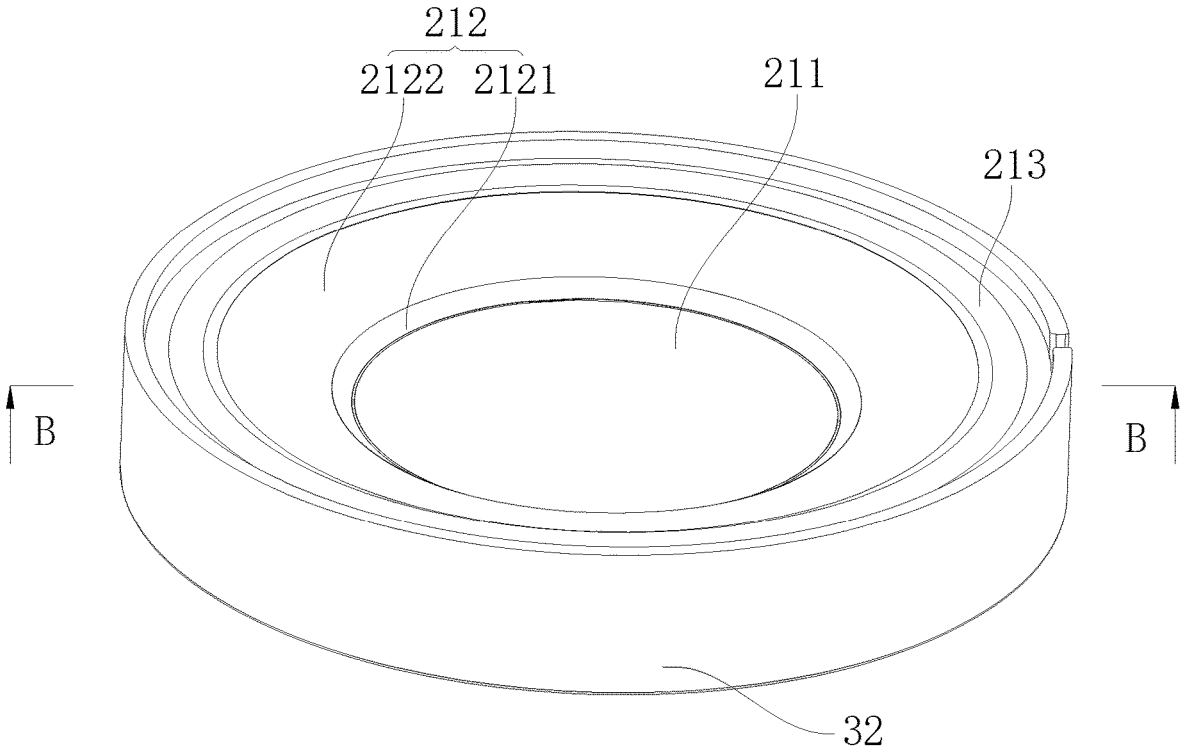
FIG. 3 is a structural schematic view of a speaker according to a second embodiment of the present application.
Figure 4:
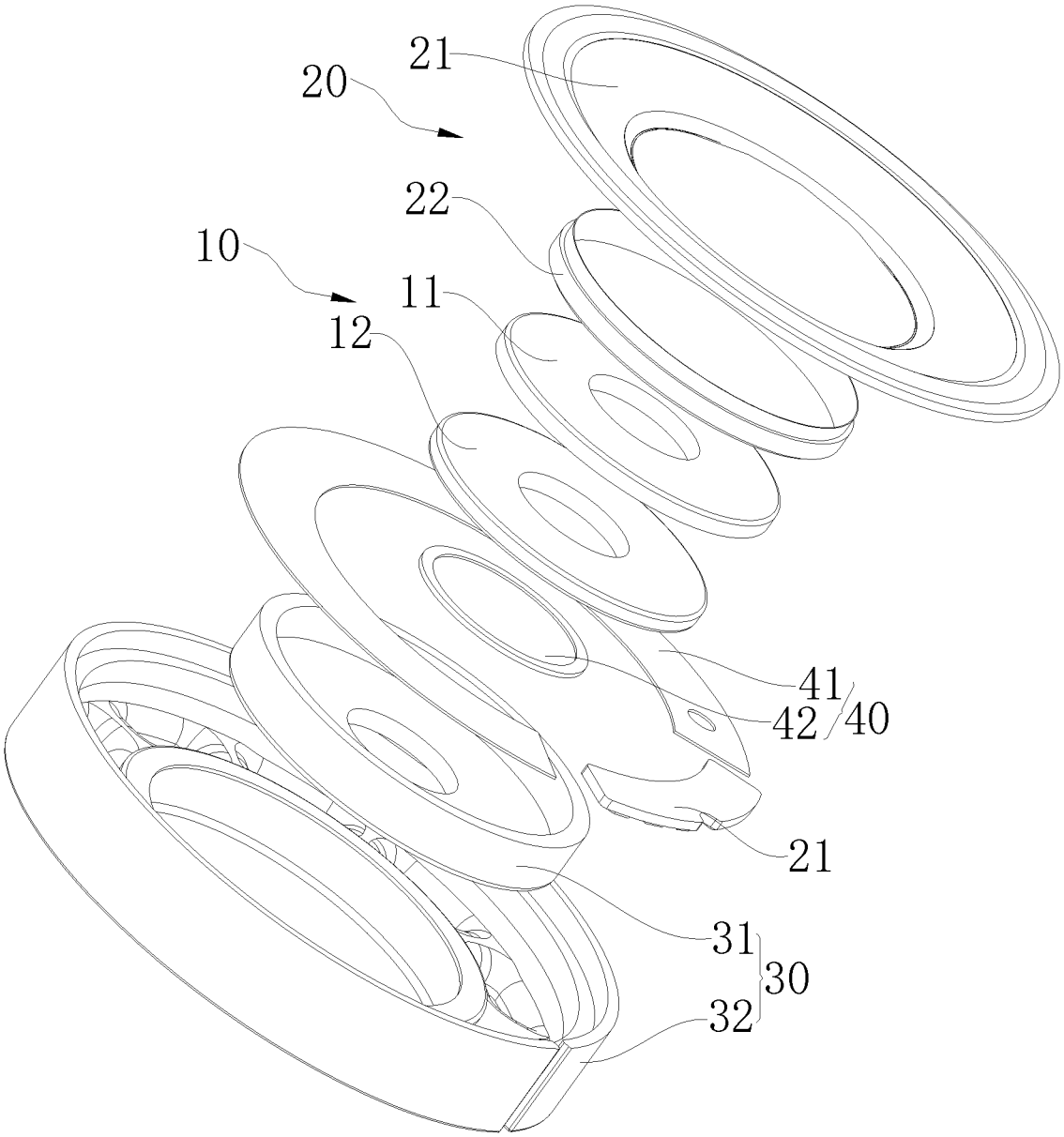
FIG. 4 is an exploded view of the speaker according to the second embodiment of the present application.

As shown in FIGS. 3-5, a second embodiment of the present application provides a speaker comprising the diaphragm 21 provided by the first embodiment.

In the speaker of the present embodiment, because the above diaphragm 21 is adopted, the vibration system 20 of the speaker has enhanced rigidity and internal damping property. The segmentation vibration of the speaker at high frequencies is reduced, the bandwidth of the speaker is effectively extended, and the distortion of the speaker is reduced, thus realizing a full-range frequency type speaker with moderate damping, wide dynamic range, and abundant sound, and improving the users' listening experience.

Particularly, as shown in FIGS. 3-5, the speaker of the present embodiment comprises: a magnetic circuit system 10, a vibration system 20, and a speaker holder 30 configured to accommodate the magnetic circuit system 10 and the vibration system 20. The speaker holder 30 comprises a speaker basket 32 and a U cup 31. The speaker basket 32 and the U cup 31 are snap-fitted together and enclose to form a mounting cavity, and the magnetic circuit system 10 and the vibration system 20 are fixed in the mounting cavity. The vibration system 20 comprises the diaphragm 21 as provided by the first embodiment, and the outer periphery of the flexible rim 213 of the diaphragm 21 which is away from the metal dome 211 is fixedly connected to the speaker basket 32.

In the present embodiment, as shown in FIGS. 4-5, the magnetic circuit system 10 comprises a magnetic member 11 and a magnet 12. Centers of the U cup 31, the magnetic member 11, and the magnet 12 are located on a same line. A center part of an inner bottom of the U cup 31 defines therein a through hole 311. Both the magnet 12 and the magnetic member 11 adopt annular structures, and inner diameters of the magnet 12 and the magnetic member 11 are the same as a diameter of the through hole 311. When the magnet 12 and the magnetic member 11 are disposed in the U cup 31, the inner rings of the magnet 12 and the magnetic member 11 are respectively aligned with the through hole 311 at the bottom of the U CUP, thus realizing the purpose of positioning. Moreover, both the magnet 12 and the magnetic member 11 are spaced apart from an inner sidewall of the U cup 31. A first magnet gap 111 is formed between the magnet 12 and the inner sidewall of the U cup 31, and a second magnet gap 121 is formed between the magnetic member 11 and the inner sidewall of the U cup 31. The first magnet gap 111 and the second magnetic gap 121 are in communication with each other.

Particularly, as shown in FIGS. 4-5, the magnetic member 11 and the magnet 12 are substantially comparable in their shapes and sizes. A lower surface of the magnet 12 is attached and fixed to an inner bottom surface of the U cup 31, an upper surface of the magnet 12 is attached to a lower surface of the magnetic member 11, and a side of the magnet 12 and a side of the magnetic member 11 are vertically aligned, such that the area of communication between the first magnet gap 111 and the second magnet gap 121 is maximum, which provides a largest space for the formation of the magnetic line, and improves the sound generation efficiency of the speaker of the present embodiment.

In the present embodiment, as shown in FIG. 5, the vibration system 20 further comprises a voice coil 22. A first end of the voice coil 22 is fixedly connected to the lower surface of the annular plain section 2121, and a second end of the voice coil 22 passes through the second magnet gap 121 and is suspended within the first magnet gap 111. As the power source of the speaker of the present embodiment, the voice coil 22 has one end in fixed connection with the lower surface of the annular plain section 2121 of the non-metallic diaphragm portion 212 of the diaphragm 21, and the other end passing through the second magnet gap 121 and suspended in the first magnet gap 111. When an external audio current signal is transmitted to the voice coil 22, the magnetic induction lines in the first magnet gap 111 and the second magnet gap 121 are cut by the voice coil 22 and mechanical vibration is therefore generated, which causes the speaker to vibrate and produce sounds.

In the present embodiment, as shown in FIGS. 4-5, the speaker further comprises a damping enhancing system 40. The damping enhancing system 40 comprises: a first damper 41 covering at an outer bottom of the speaker basket 32, and a second damper 42 covering at an outer bottom of the U cup 31. The arrangements of the first damper 41 and the second damper 42 respectively at the outer bottom of the speaker basket 32 and the outer bottom of the U cup 31 enhance the damping property of the diaphragm 21, reduce a vibration counterforce of the diaphragm 21, increase the vibration effect of the diaphragm 21, and prevent the diaphragm 21 from deteriorating due to the metal material of the metal dome 211, and thus improve the sound generation effect of the speaker. Particularly, both the first damper 41 and the second damper 42 of the present embodiment are made of materials with relatively good damping property, such as damping paper, damping rubber, and damping plastic, which are common in the market, and are preferably damping paper with cheap price and excellent damping property.

In the present embodiment, as shown in FIGS. 4-5, the speaker further comprises a circuit board 50. The circuit board 50 is fixedly connected with the speaker basket 32, and the circuit board 50 is electrically connected to the voice coil 22. The speaker of the present embodiment realizes the connection of the internal circuit and the external circuit through the circuit board 50, such that the audio signal current outside the speaker is transmitted to an internal part of the speaker via the circuit board 50.

The above description is only optional embodiments of the present application, and is not intended to limit the present application. Any modifications, equivalent substitutions, and improvements made within the spirit and principles of the present application are included within the protection scope of the present application.

What is claimed is:

1. A diaphragm, comprising:

a metal dome comprising a metal dome outer periphery, wherein the metal dome has a convex direction;

a non-metallic diaphragm portion bonded to the metal dome outer periphery and comprising a non-metallic diaphragm portion outer periphery that extends in a direction corresponding to the convex direction and expands radially away from the metal dome; and a flexible rim bonded to the non-metallic diaphragm portion outer periphery, wherein the non-metallic diaphragm portion comprises an annular plain section and a horn-like conical section, wherein the annular plain section comprises an annular plain section outer periphery, an annular plain section upper surface, and an annular plain section lower surface, wherein the annular plain section is formed by extending the metal dome outer periphery in a direction perpendicular to the convex direction away from the metal dome, wherein both of the annular plain section upper surface and the annular plain section lower surface are regularly flat and in parallel with a plane perpendicular to the convex direction, and wherein the horn-like conical section is formed by folding an annular plain section outer periphery toward the convex direction and expanding the annular plain section outer periphery away from the metal dome.

2. The diaphragm of claim 1, wherein the horn-like conical section comprises a horn-like conical section outer periphery, and wherein a maximum height of the horn-like conical section outer periphery is greater than a height of the metal dome.

3. The diaphragm of claim 1, wherein a cross section of the metal dome and the non-metallic diaphragm portion together form a W shape.

4. The diaphragm of claim 1, wherein the flexible rim further comprises an intermediate portion, and wherein the intermediate portion is arched toward the convex direction to form a curved structure.

5. The diaphragm of claim 1, wherein the metal dome is made of at least one material selected from the group consisting of magnesium, aluminum, beryllium, and titanium.

6. The diaphragm of claim 1, wherein the non-metallic diaphragm portion is made of paper, a mixture of paper and mica, a mixture of paper and a blended fabric material, or a biological diaphragm material.

7. The diaphragm of claim 1, wherein the flexible rim is made of a polyurethane material, a silica gel, a plastic, a resin, a silk, or a cloth.

8. The diaphragm of claim 1, wherein a thickness of the metal dome is from 6 micrometers (μm) to 120 μm.

9. The diaphragm of claim 1, wherein the metal dome and the non-metallic diaphragm portion are bonded together by a positive bonding process or a reverse bonding process.

10. A speaker comprising a vibration system, wherein the vibration system comprises:

a diaphragm comprising:

a metal dome comprising a metal dome outer periphery, wherein the metal dome has a convex direction;

a non-metallic diaphragm portion bonded to the metal dome outer periphery and comprising a non-metallic diaphragm portion outer periphery that extends in a direction corresponding to the convex direction and expands radially away from the metal dome; and a flexible rim bonded to the non-metallic diaphragm portion outer periphery, wherein the non-metallic diaphragm portion comprises an annular plain section and a horn-like conical section, wherein the annular plain section comprises an annular plain section outer periphery, an annular plain section upper surface, and an annular plain section lower surface, wherein the annular plain section is formed by extending the metal dome outer periphery in a direction perpendicular to the convex direction away from the metal dome, wherein both of the annular plain section upper surface and the annular plain section lower surface are regularly flat and in parallel with the direction perpendicular to the convex direction, and wherein the horn-like conical section is formed by folding an annular plain section outer periphery toward the convex direction and expanding the annular plain section outer periphery away from the metal dome.

11. The speaker of claim 10, wherein the horn-like conical section comprises a horn-like conical section outer periphery, and wherein a maximum height of the horn-like conical section outer periphery of the non-metallic diaphragm portion is greater than a height of the metal dome.

12. The speaker of claim 10, wherein a cross section of the metal dome and the non-metallic diaphragm portion together form a W shape.

13. The speaker of claim 10, wherein the flexible rim further comprises an intermediate portion, and wherein the intermediate portion is arched toward the convex direction to form a curved structure.

14. The speaker of claim 10, wherein the metal dome is made of at least one material selected from the group consisting of magnesium, aluminum, beryllium, and titanium.

15. The speaker of claim 10, wherein the non-metallic diaphragm portion is made of paper, a mixture of paper and mica, a mixture of paper and a blended fabric material, or a biological diaphragm material.

16. The speaker of claim 10, wherein the flexible rim is made of a polyurethane material, a silica gel, a plastic, a resin, a silk, or a cloth.

17. The speaker of claim 10, further comprising:

a magnetic circuit system; and a speaker holder configured to accommodate the magnetic circuit system and the vibration system and comprising a speaker basket and a U cup, wherein the speaker basket and the U cup are snap-fit together and enclosed to form a mounting cavity, wherein the magnetic circuit system and the vibration system are fixed in the mounting cavity, and wherein an outer periphery of the flexible rim of the diaphragm which is away from the metal dome is fixedly connected to the speaker basket.

18. The speaker of claim 17, wherein the magnetic circuit system comprises a magnetic member and a magnet, wherein centers of the U cup, the magnetic member, and the magnet are aligned at a same line, wherein a center part of an inner bottom of the U cup defines therein a through hole, wherein both the magnet and the magnetic member adopt annular structures, wherein inner diameters of the magnet and the magnetic member are the same as a diameter of the through hole, wherein the magnet and the magnetic member are disposed in the U cup, wherein inner rings of the magnet and the magnetic member are respectively aligned with the through hole at the bottom of the U cup, wherein both the magnet and the magnetic member are spaced apart from an inner sidewall of the U cup, wherein a first magnet gap is formed between the magnet and the inner sidewall of the U cup, wherein a second magnet gap is formed between the magnetic member and the inner sidewall of the U cup, and wherein the first magnet gap and the second magnetic gap are in communication with each other.

19. The speaker of claim 18, wherein the vibration system further comprises a voice coil, wherein a first end of the voice coil is fixedly connected to the annular plain section lower surface, and wherein a second end of the voice coil passes through the second magnet gap and is suspended within the first magnet gap.

20. The speaker of claim 19, further comprising a damping enhancing system, wherein the damping enhancing system comprises a first damper covering at an outer bottom of the speaker basket and a second damper covering at an outer bottom of the U cup.

* * * * *